US005542882A

United States Patent [19]

Sells

[11] Patent Number: 5,542,882

[45] Date of Patent: Aug. 6, 1996

[54] ROOF VENTILATING CAP

[75] Inventor: Gary L. Sells, Mishawaka, Ind.

[73] Assignee: Cor-A-Vent, Inc., Mishawaka, Ind.

[21] Appl. No.: 501,584

[22] Filed: Jul. 12, 1995

Related U.S. Application Data

[63] Continuation-in-part of Ser. No. 333,438, Nov. 2, 1994, Pat. No. 5,439,417.

[51] Int. Cl.[6] ..... F24F 7/02

[52] U.S. Cl. ..... 454/365; 52/57; 52/199

[58] Field of Search ..... 52/57, 199; 454/364, 454/365

[56] References Cited

U.S. PATENT DOCUMENTS 4,803,813 2/1989 Fiterman ..... 454/365 X 5,094,041 3/1992 Kasner et al. ..... 454/365 X 5,149,301 9/1992 Gates ..... 454/365

*Primary Examiner*—Harold Joyce

*Attorney, Agent, or Firm*—Baker & Daniels

[57] ABSTRACT

The ventilating cap for the ridge of a roof includes multiple plies of ventilating material disposed on opposite sides of an opening cut along the ridge of the roof. The ventilating cap includes a connecting ply which interconnects a pair of vent parts disposed on opposite sides of the vent opening. The connecting ply is folded along a crease line, and, according to one embodiment of the invention, includes a groove which extends longitudinally along the connecting ply at the crease line to permit a consistent fold of the connecting ply. According to another embodiment of the invention, the groove consists of two channels which cooperate to form a rib running along the center of the groove. The rib stabilizes the fold, thereby permitting a consistent fold about the rib.

10 Claims, 10 Drawing Sheets

ROOF VENTILATING CAP

This application is a continuation-in-part of U.S. patent application Ser. No. 08/333,438, filed Nov. 2, 1994, U.S. Pat. No. 5,439,417.

This invention relates to a ventilating cap for the ridge of a roof and the method for its manufacture.

The ventilating cap of this invention includes a pair of vent parts extending along a vent opening cut along the ridge of the roof. The vent parts each include multiple plies of a corrugated material that define vent passages venting the vent opening to ambient atmosphere. The lower ply of each vent part directly engages the roof, and the upper ply of the vent parts bridges across the vent opening to interconnect the vent parts. The upper ply must be folded; it is often difficult to provide a uniform fold along the ridge line of the roof.

According to one embodiment of the present invention, a groove is cut into the corrugated layer of the upper ply of the venting material such that the groove extends longitudinally along the ridge of the roof. Roll forming equipment is used to create a longitudinally extending, arcuate section of the groove substantially midway between the edges thereof. According to another embodiment of the present invention, a groove is defined by two channels cut into the corrugated layer of the upper ply of the venting material such that the channel extends longitudinally along the ridge of the roof. Two channels define a rib therebetween. The rib causes the upper ply, when folded to maintain a constant fold along the ridge of the roof. Prior art methods of providing a fold in the upper ply are disclosed in U.S. Pat. No. 5,094,041.

These and other advantages of the present invention will become apparent from the following specification, with reference to the accompanying drawings, in which.

Figure 1:
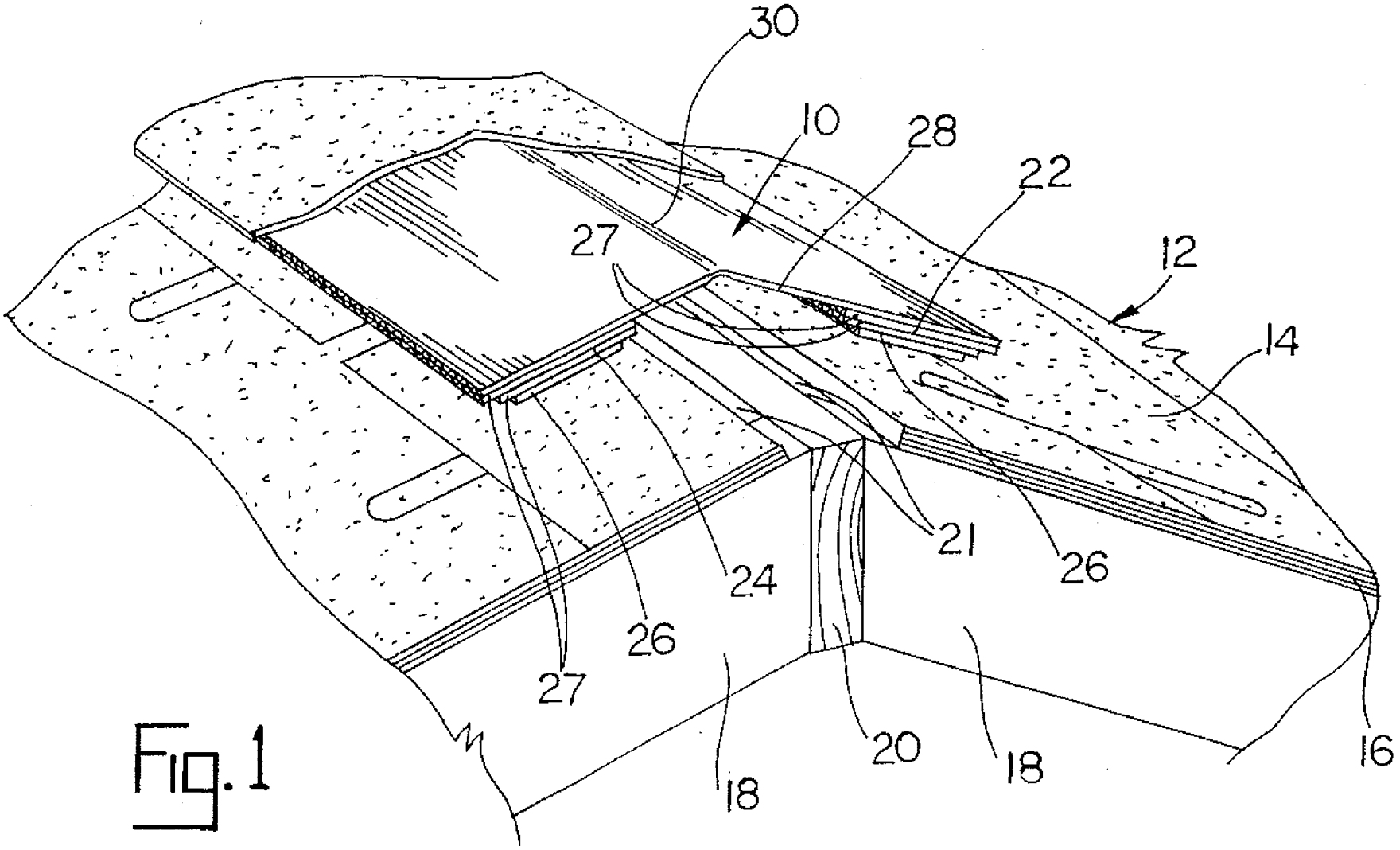
FIG. 1 is a fragmentary view in perspective of a roof illustrating the ventilating cap made pursuant to teachings of the present invention installed over a vent opening in the roof.

Referring now to the drawings a ventilating cap generally indicated by the numeral 10 is applied to a roof generally indicated by the numeral 12. The roof 12 includes shingles 14 which are applied to underlayment 16, which is supported by rafters 18. A ridge board 20 extends along the ridge of the roof and interconnects the rafters 18. The underlayment 16 is cut away as to form a vent opening generally indicated by the numeral 21 on both sides of the ridge board 20. Ventilating cap 10 includes vent parts 22 and 24 which consist of plies 26 of a corrugated material which defines passages to thereby communicate vent opening 20 with ambient atmosphere. The lowermost plies 26 of the vent parts 22, 24 are applied against the shingles 14 and the upper ply 28 of both vent parts 22, 24 bridges the vent opening 21 and thus interconnects the vent parts 22, 24. The upper ply 28 must be creased as at 30 such that the upper ply 28 of the vent parts 22, 24 extends substantially parallel to the opposed upwardly tapering portions of the roof 12 on opposite sides of the ridge board 20. Intermediate plies 27 extend between lower plies 26 and upper ply 28.

Figure 6:
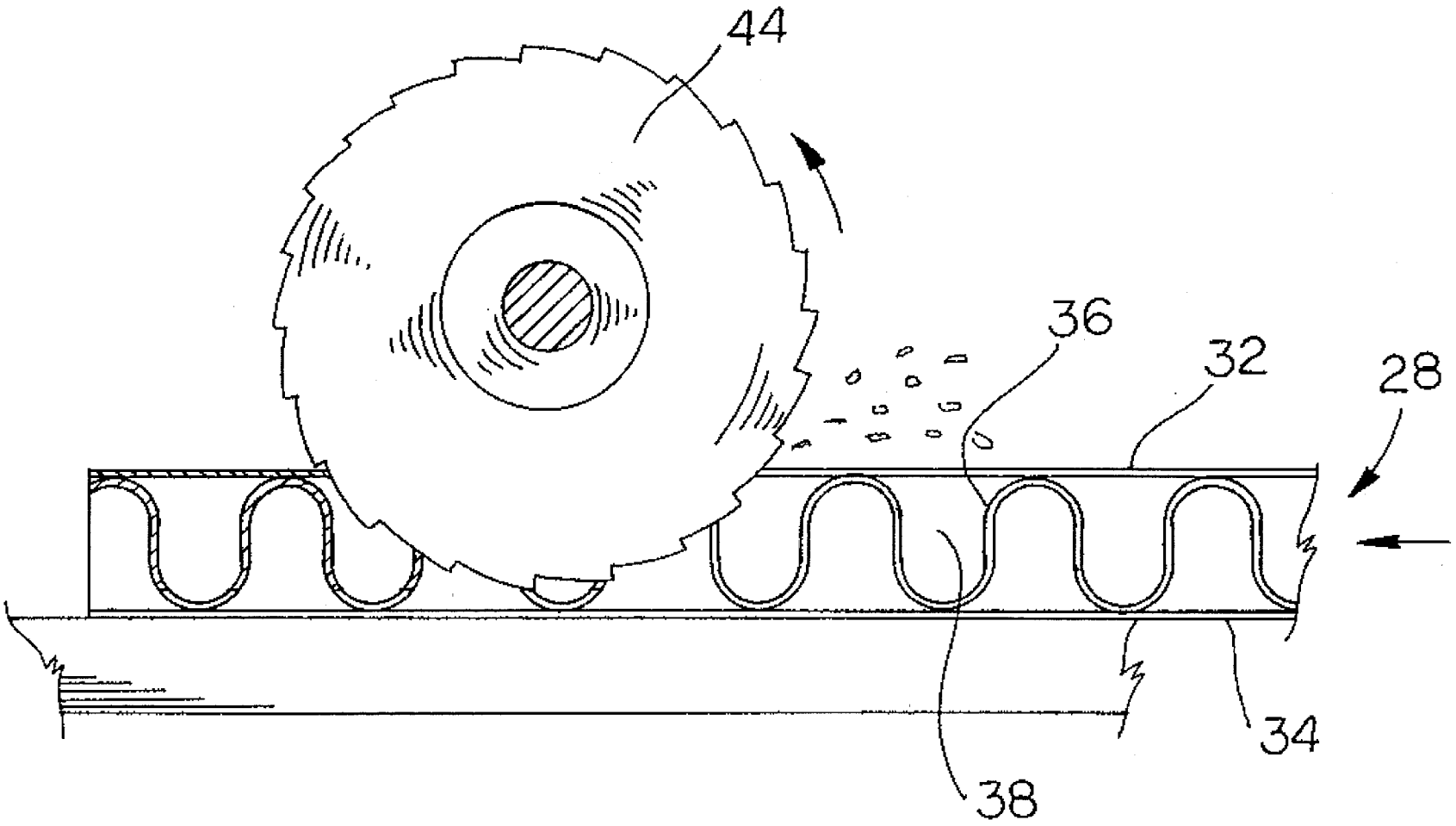
FIG. 6 is a view taken substantially along line 6—6 of FIG. 4.
Figure 7:
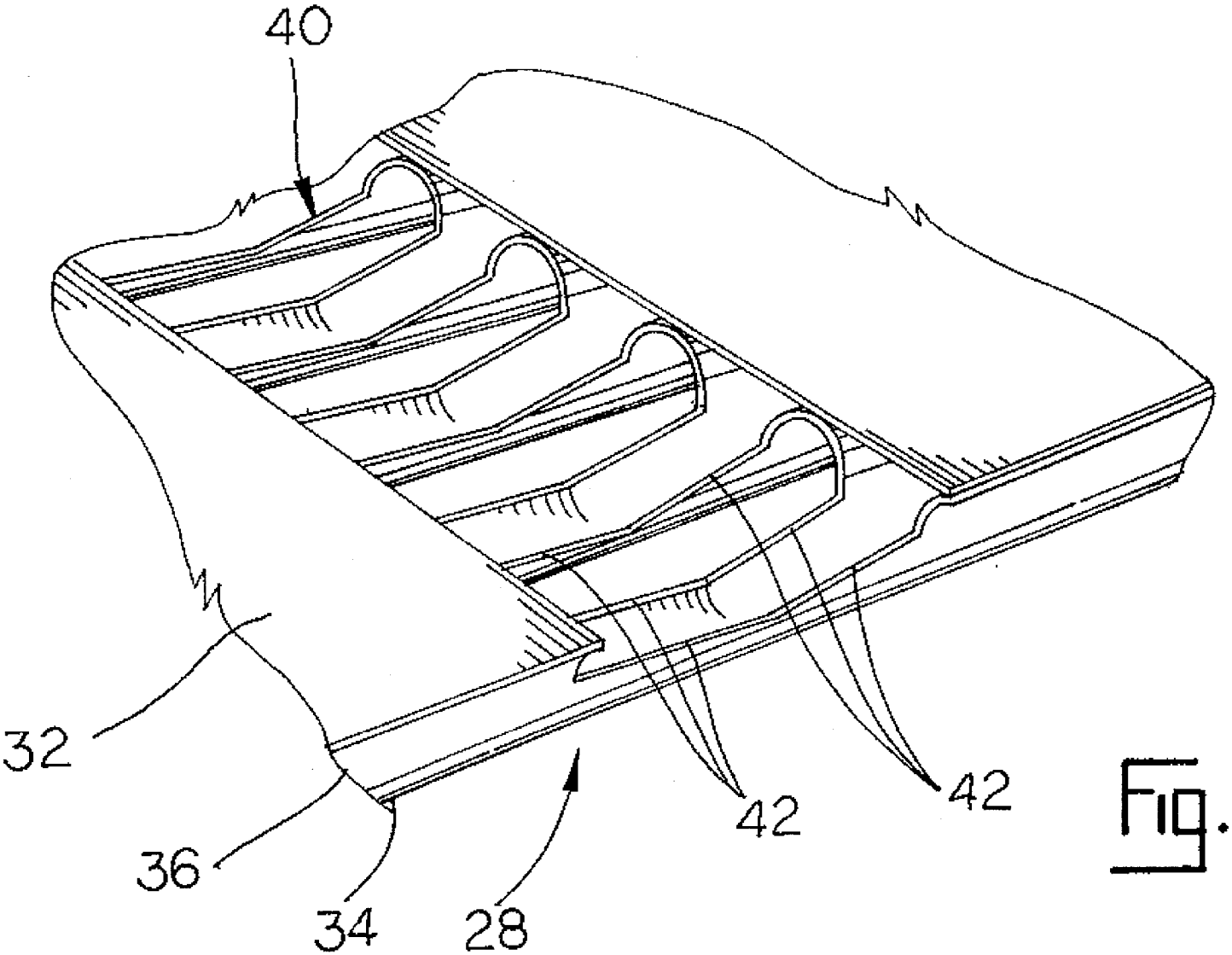
FIG. 7 is a view in perspective of the groove cut in the connective ply of the ventilating cap illustrated in FIG. 5.
Figures 8, 9:
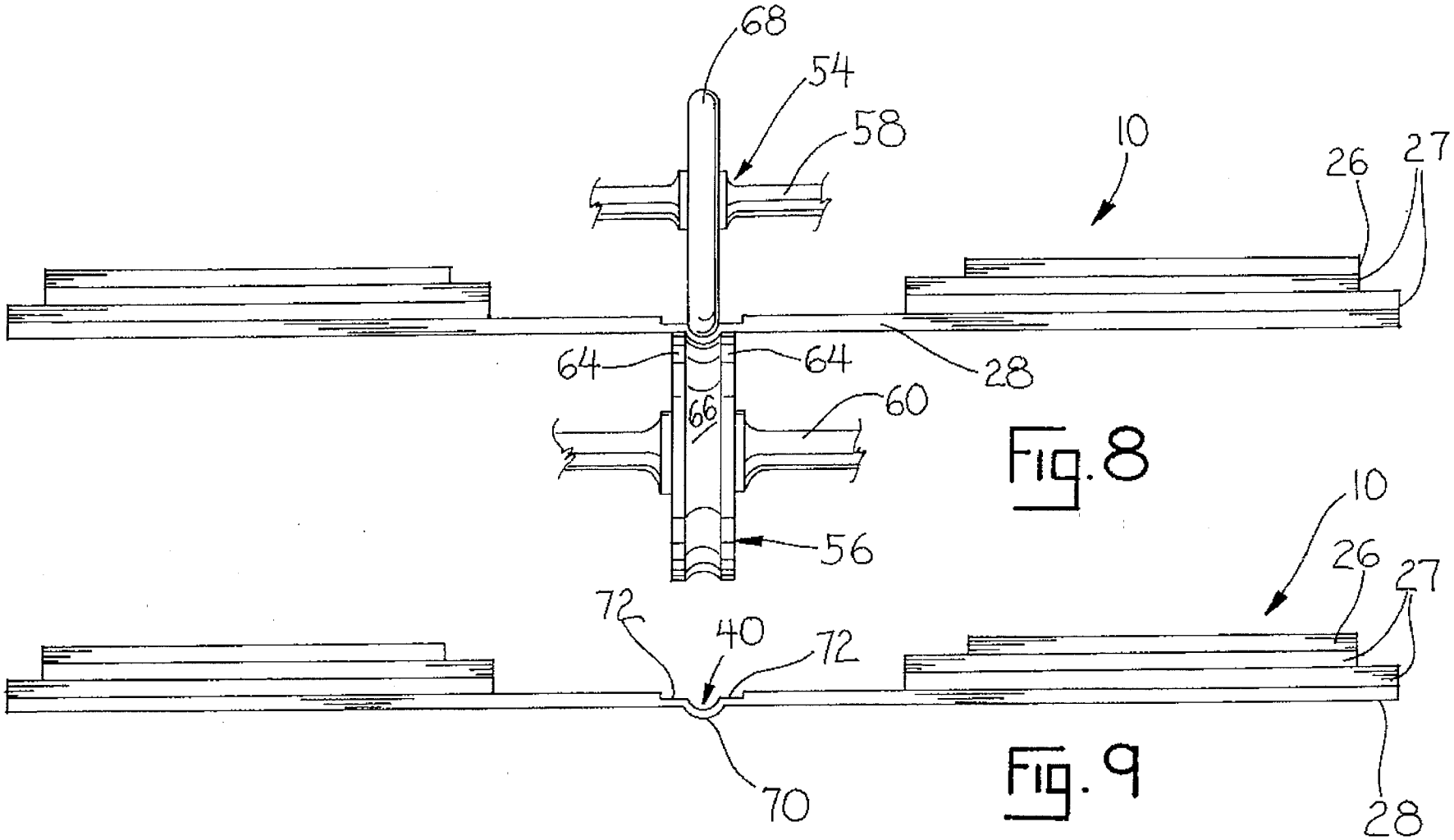
FIG. 8 is a view similar to FIG. 4 but illustrating roll forming tools which form an arcuate curve in a portion of the groove cut in the connecting ply of the ventilating cap by the apparatus illustrated in FIG. 4.
FIG. 9 is a view similar to FIG. 8 but illustrating the contour of the ventilating cap after the latter has been passed forth through the roll forming rollers of FIG. 8.
Figure 10:
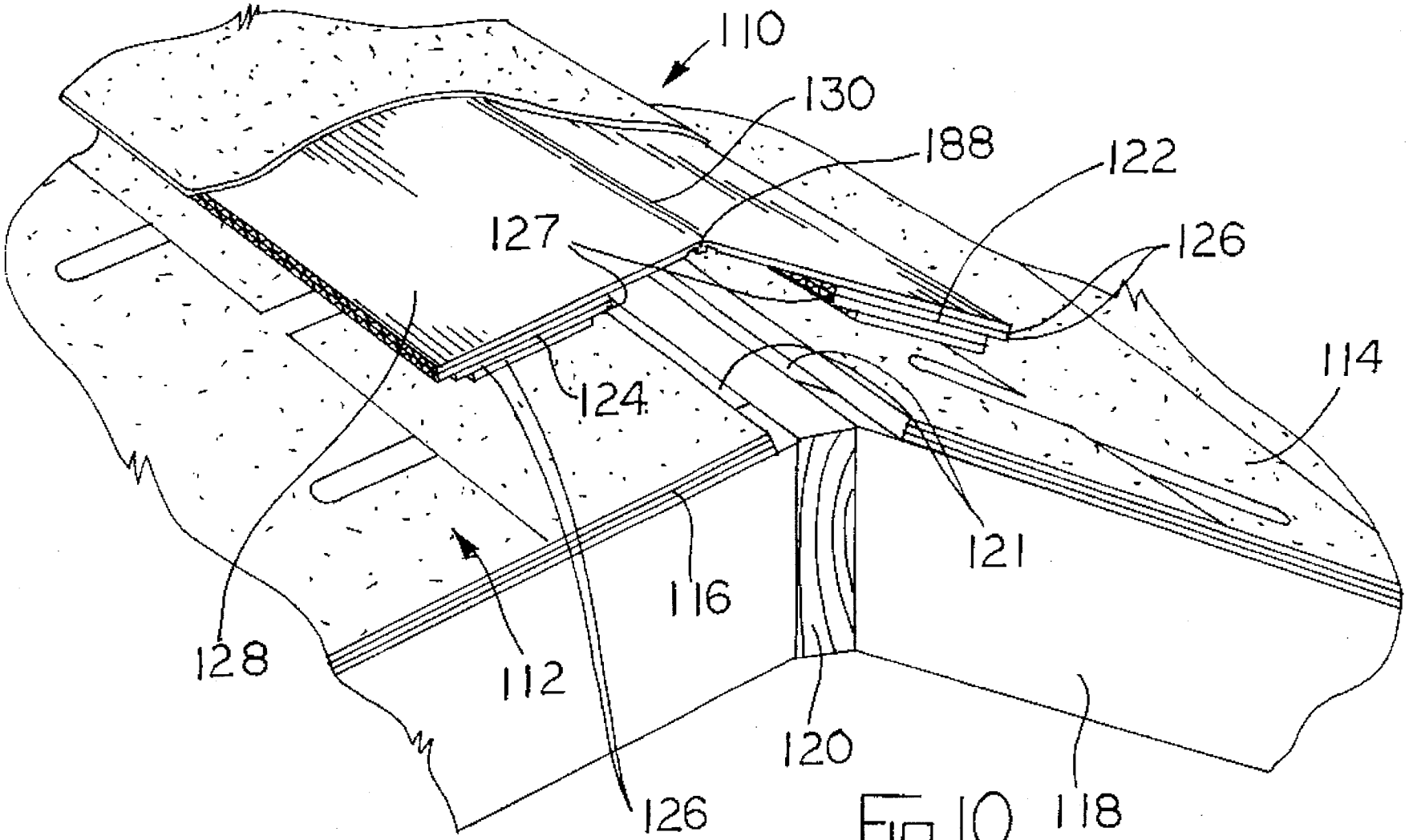
FIGS. 10–15 are views similar to FIGS. 1–3, 7, 4 and 5 respectively, but illustrating an alternate embodiment of the invention.

As is best illustrated in FIGS. 6 and 7, each of the plies 26–28 of the ventilating cap 10 includes upper and lower layers 32, 34 which are separated by a corrugated intermediate layer 36. The corrugated intermediate layer 36 defines the vent passages 38 which communicate the vent opening 20 with ambient atmosphere. Each ply 26–28 may be made out of plastic or paperboard dipped in plastic.

Figure 4:
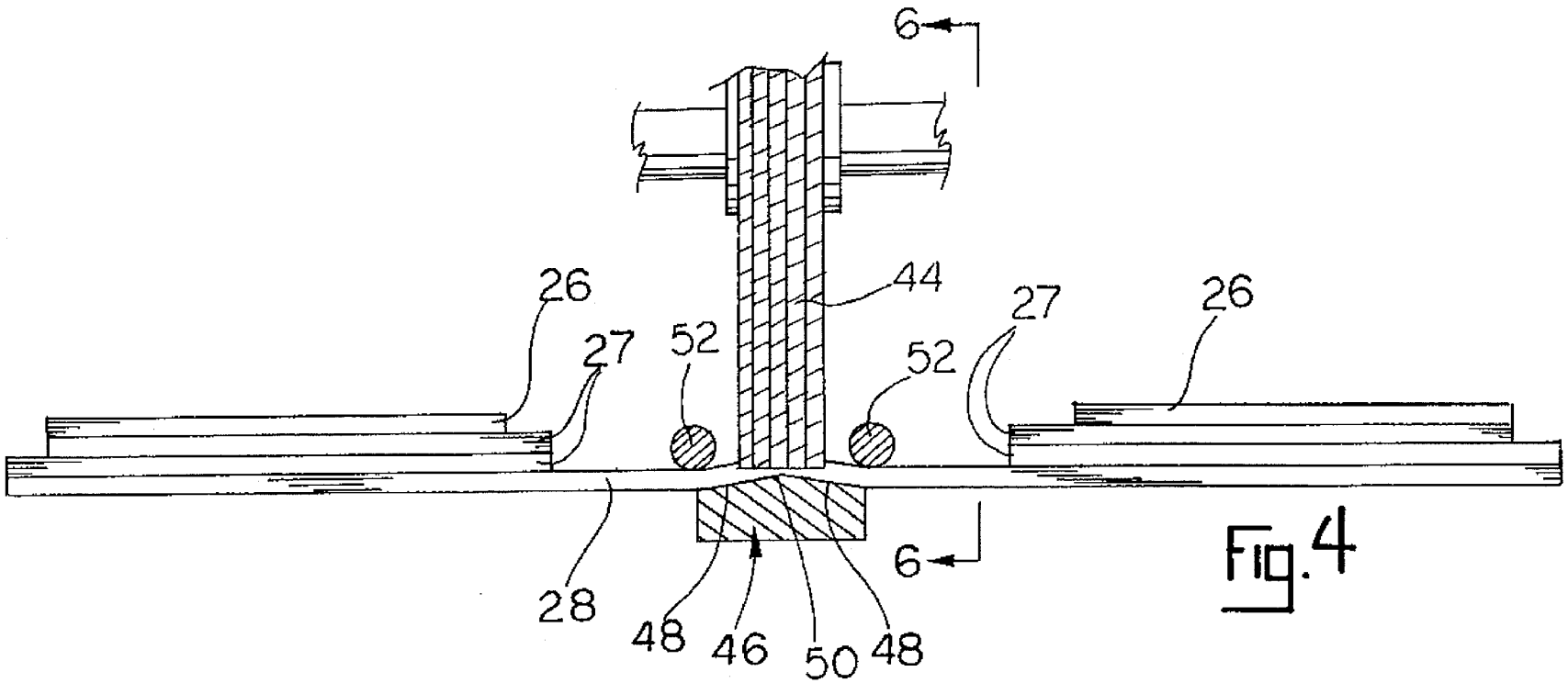
FIG. 4 is an end view of a cutting head and supporting die which illustrates the manner in which a groove is cut into the upper ply of the ventilating cap illustrated in FIG. 1 during its manufacture.
Figure 5:
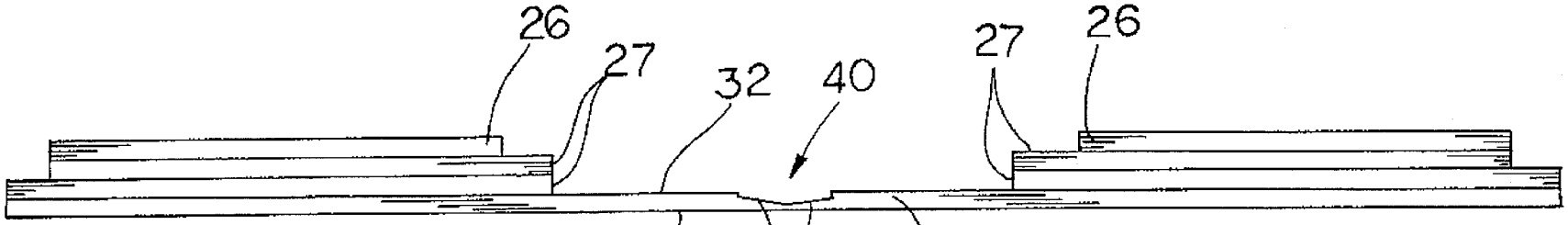
FIG. 5 is a view similar to FIG. 4 but illustrating the ventilating cap after the groove has been cut in the tipper ply of the ventilating cap by the cutting device illustrated in FIG. 4.

It is important that the crease 30 be formed consistently along the length of the ventilating cap 10. It is difficult to fold corrugated material, because the corrugated intermediate layer 36 of the connecting ply 28 prevents folding in a straight, consistent, crease line. Accordingly, during manufacture of the ventilating cap 10, a groove generally indicated by the numeral 40 is cut along the midline of the connecting ply 28. As most clearly illustrated in FIG. 5, the bottom of the groove is defined by two sloping segments 42, each of which slope toward the layer 34 and meet along substantially the centerline of the ply 28. Referring to FIGS. 4 and 6, the groove 40 is formed by a cutting head 44 of multiple cutting blades which form a thickness equal to the desired width of the groove 40. The ply 28 is held against a die 46 having upwardly sloping surfaces 48 that meet at 50 to thereby form the sloping segments 42 of the groove 40. The ply 28 is held against the die by 46 by hold down devices 52 as the groove is cut by the cutting head 44.

Figure 2:
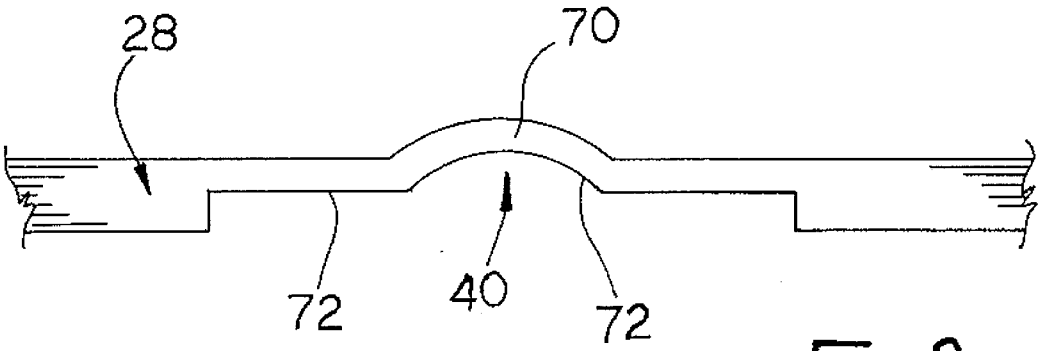
FIG. 2 is an end view of the upper ply of venting material used in the ventilating cap of FIG. 1 before the material has been bent to conform to the slope of the roof.
Figure 3:
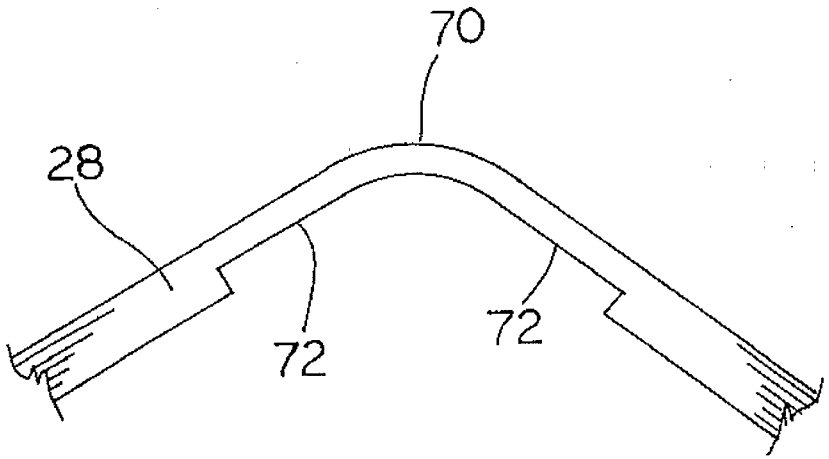
FIG. 3 is a view similar to FIG. 2 but illustrating the upper ply of the ventilating cap after it has been bent to assume the contour of the roof.

After the groove 40 is formed by the cutting head 44, the ventilating cap 10 is passed through a set of roll forming rollers 54, 56, which are mounted for rotation on corresponding axles 58, 60. The roller 56 includes a pair of substantially flat raised portions 62 which are separated by an arcuate surface 66. The roller 54 is defined by an outer arcuate surface 68 which is compatible with the surface 66 on roller 56. The ventilating cap 10 and the connecting ply 28 thereof is passed through the rollers 54, 56 such that the rollers roll along substantially the center line of the groove 40, such that the surfaces 66, 68 cooperate to define an arcuate surface 70 and the surfaces 62, 64 exert a bias on the ply 28 which flattens the edges of the groove 40 as at 72. Accordingly, as illustrated in FIGS. 2 and 3, a consistent crease can be formed which is defined by the arcuate surface 70, which is substantially stable along the entire length of the ventilating cap 10.

Figure 11:
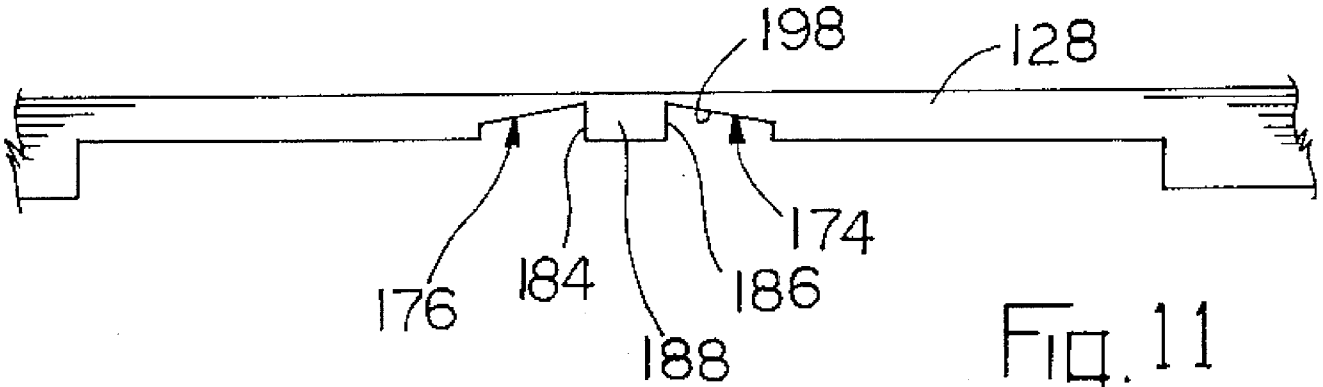
Figure 12:
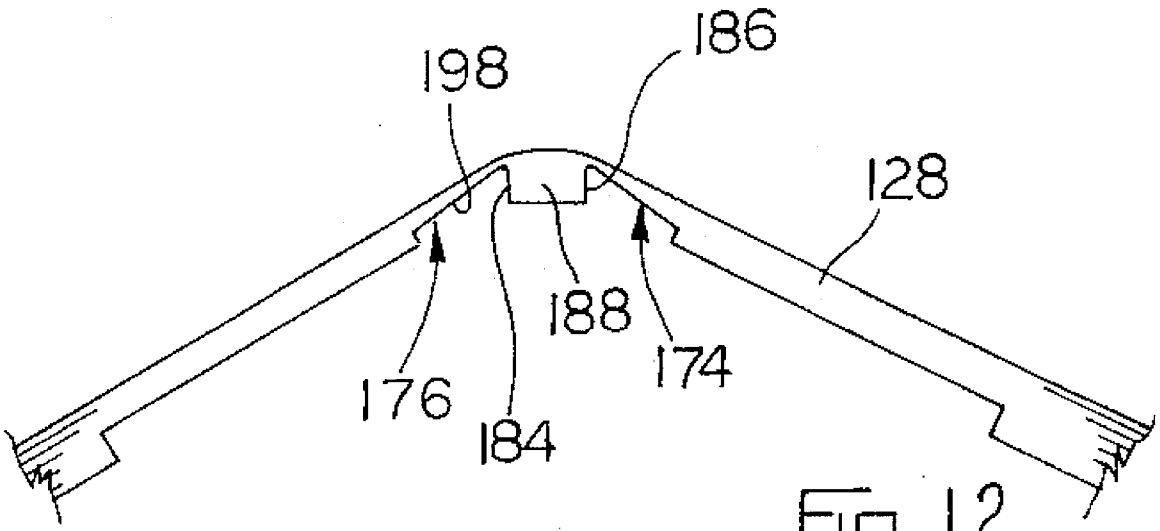
Figure 13:
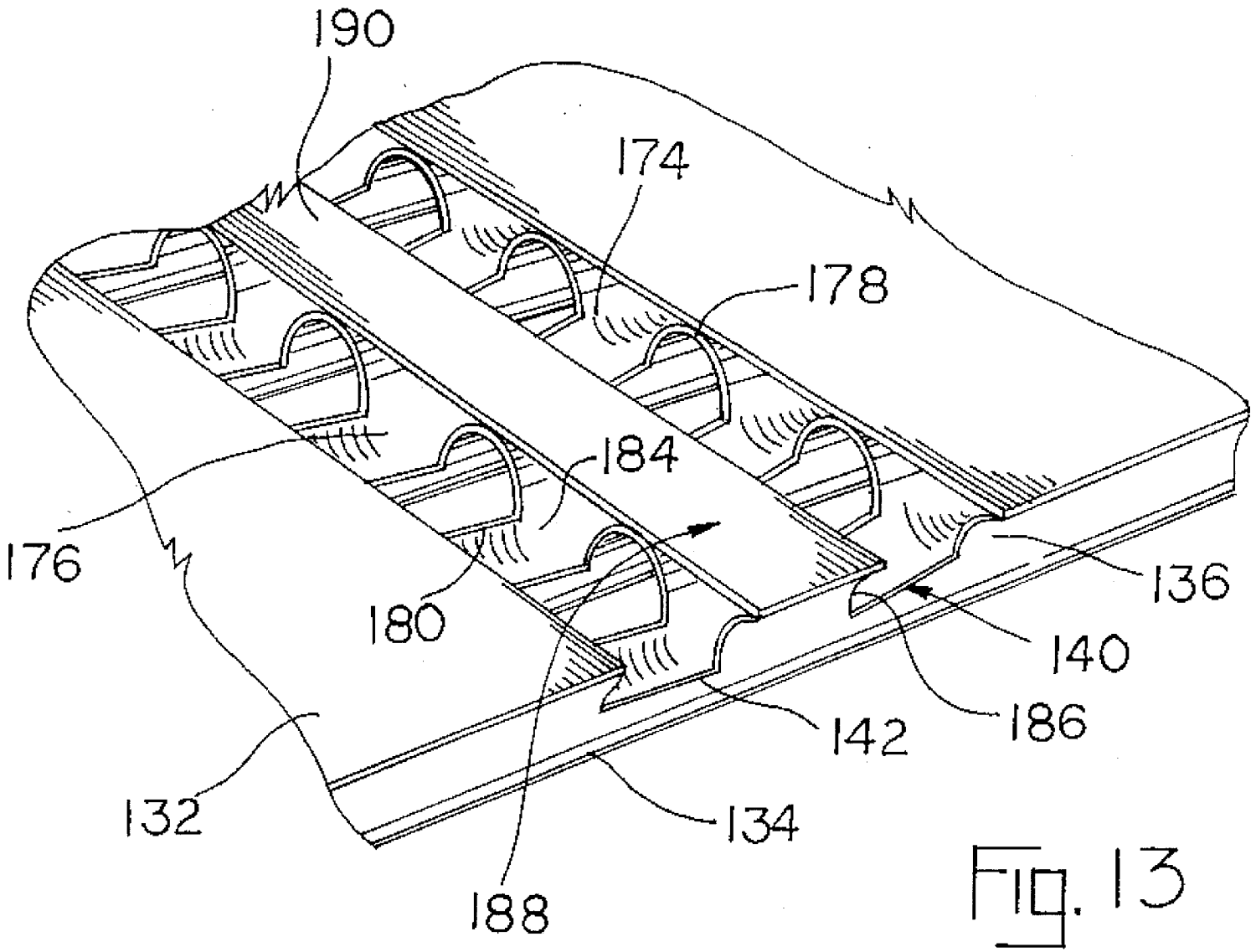
Figures 14, 15:
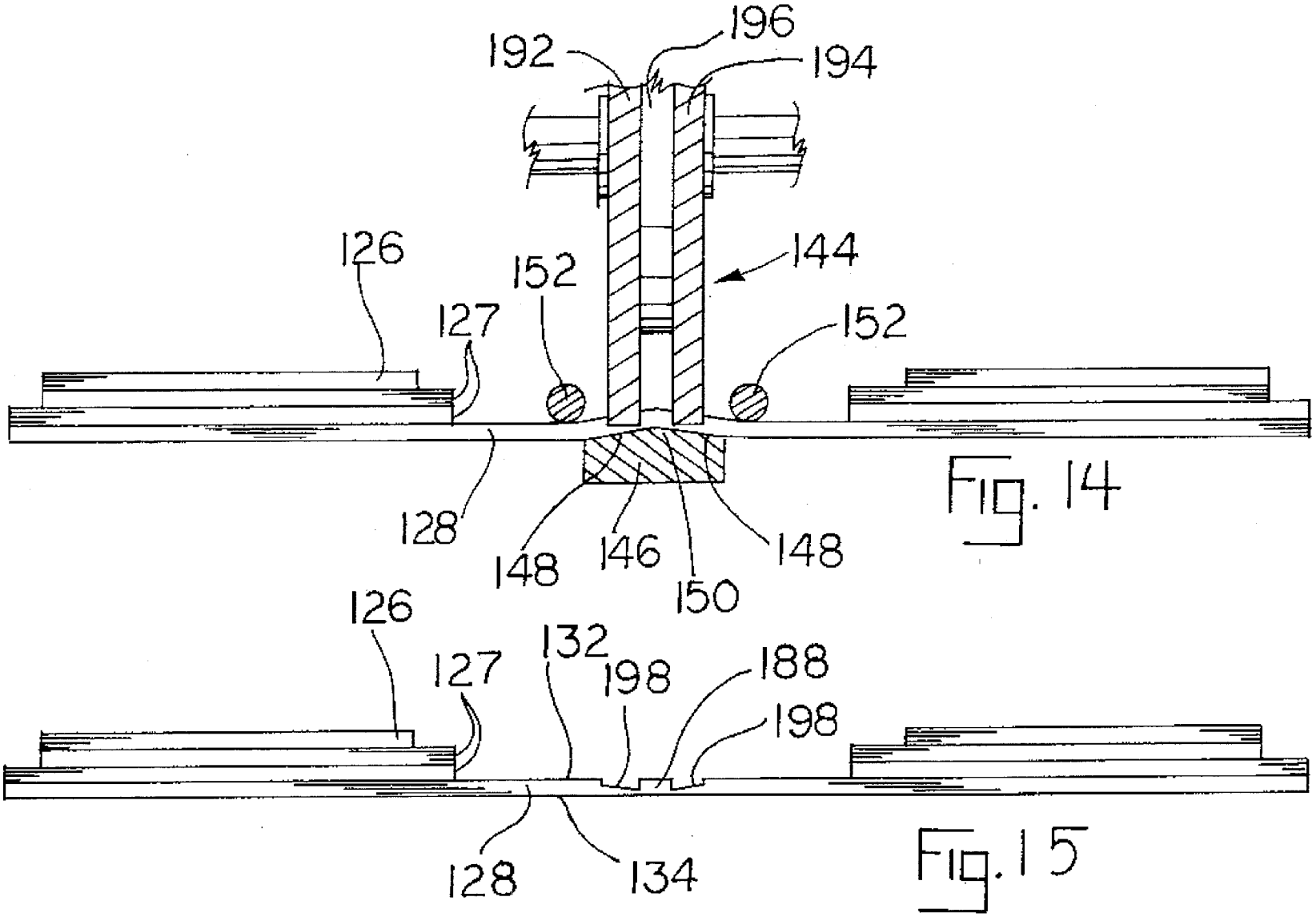

Referring now to the alternate embodiment of FIGS. 10–15, elements the same or substantially the same as those in the embodiment of FIGS. 1–9 retain the same reference numeral, but increased by 100. In FIGS. 10–15, the groove 140 consists of a pair of channels 174, 176 defined between edge portions 178, 180 of the groove 142 and corresponding edges 184, 186 of a rib generally indicated by the numeral 188 which is left between the channels 174, 176 when the channels 174, 176 are cut as will hereinafter be explained. The upper sheet 132 also forms the surface 190 of the rib 188. Accordingly, when the upper ply 128 is folded, the rib 188 acts as a reinforcement to force a consistent crease along the edges 184, 186 of the rib 188, as illustrated in FIGS. 11 and 12. The channels 174, 176 of the groove 140 are cut by the cutting head 144 (FIG. 14). Cutting head 144 includes cutters 192, 194 separated by a spacer 196, the spacer 196 being the same width as that of the rib 190. Each of the cutters 192, 194 cut along the channels 174, 176. As illustrated in FIG. 14, the dye 146 raises the portion of the ply to form the sloping bottom portions 198 of the channels 174, 176.

I claim:

1. A ventilating cap for the ridge of a roof, said roof having opposed upwardly tapering portions tapering upwardly toward said ridge, said roof having a longitudinal opening therein extending along said ridge, said ventilating cap comprising a pair of elongated vent parts extending along said upwardly tapering portions on opposite sides of said ridge, each of said vent parts including multiple plies of material defining passages communicating said opening with ambient atmosphere, each of said vent parts further including a bottom ply engaging said roof and an upper ply, said upper ply including a connecting portion extending across and along said ridge to interconnect said vent parts, and a groove in said connecting portion and extending along said ridge, said groove having edge portions extending longitudinally along both of the edges of said groove, and a longitudinally extending rib within said groove between the edge portions thereof, said upper ply being folded along said groove to extend over said ridge.

2. Ventilating cap as claimed in claim 1, wherein said upper ply includes a lower sheet engaging said vent parts, an upper sheet, and an intermediate layer between said sheets defining said passages, said groove extending through said lower sheet and into said intermediate layer, said groove having a bottom defined within said intermediate layer, said rib projecting from said bottom toward said lower sheet.

3. Ventilating cap as claimed in claim 1, wherein the height of the rib is substantially equal to the depth of the groove.

4. Ventilating cap as claimed in claim 2, wherein said rib is defined between a pair of longitudinally extending surfaces, said groove being defined by a pair of longitudinally extending channels defined between each of said surfaces and a corresponding one of said edge portions.

5. Ventilating cap as claimed in claim 4, wherein said rib includes an outer surface extending between said longitudinally extending surfaces, said outer surface being defined by said lower sheet.

6. Method of manufacturing a ventilating cap for the ridge of a roof, said method including the steps of forming multiple plies of material, each ply defining passages, assembling said plies into two elongated stacks extending between a bottom ply to a top ply with a connecting portion of the top ply bridging between said stacks, forming a pair of longitudinally extending, substantially parallel channels in said connecting portion, said channels cooperating with one another to define a longitudinally extending rib therebetween.

7. Method of manufacturing a ventilating cap as claimed in claim 6, wherein said method includes the step of forming a pair of substantially flat surfaces along the edge portions of the channels.

8. Method of manufacturing a ventilating cap as claimed in claim 6, wherein said channels are formed by a cutting head.

9. Method of manufacturing a ventilating cap as claimed in claim 6, wherein said channels are formed by a cutting head having a pair of cutters rotatable together about a common shaft with a spacer therebetween, said spacer having a width equal to the width of said rib.

10. Method of manufacturing a ventilating cap as claimed in claim 6, wherein the step of forming said top ply includes the steps of providing a pair of sheets, assembling said upper and lower sheets to a convoluted intermediate sheet to define said passages, and cutting said channels through one of said sheets and into said intermediate sheet to form said rib.

* * * * *